US007398862B2

(12) United States Patent
Dziwak

(10) Patent No.: US 7,398,862 B2
(45) Date of Patent: Jul. 15, 2008

(54) CAR DOOR LOCK

(75) Inventor: Zygmunt Dziwak, Mississauga (CA)

(73) Assignee: The Peelle Company Ltd., Ontario (CA)

( * ) Notice: Subject to any disclaimer, the term of this patent is extended or adjusted under 35 U.S.C. 154(b) by 0 days.

(21) Appl. No.: 11/421,853

(22) Filed: Jun. 2, 2006

(65) Prior Publication Data

US 2008/0000727 A1 Jan. 3, 2008

(51) Int. Cl.
*B66B 13/12* (2006.01)

(52) U.S. Cl. ..... 187/319; 187/331; 187/335; 187/330; 49/120

(58) Field of Classification Search ..... 187/338, 187/335, 330, 331, 339, 319; 49/120, 449; *B66B 13/06, B66B 13/12, 13/00*
See application file for complete search history.

(56) References Cited

U.S. PATENT DOCUMENTS 4,947,964 A * 8/1990 Husmann ..... 187/319
5,246,089 A * 9/1993 Husmann et al. ..... 187/319
6,474,448 B1 * 11/2002 Zappa ..... 187/339
7,077,242 B2 * 7/2006 Cocher ..... 187/330
2005/0139429 A1 * 6/2005 Bisang et al. ..... 187/319

FOREIGN PATENT DOCUMENTS

EP 1266860 A1 * 12/2002
JP 2005280854 A * 10/2005

* cited by examiner

*Primary Examiner*—Peter M. Cuomo
*Assistant Examiner*—Stefan Kruer
(74) *Attorney, Agent, or Firm*—Pearne & Gordon LLP

(57) ABSTRACT

A door locking system for a freight or passenger elevator or goods lift installation having vertically spaced landings served by a vertically movable car, the landings and car each being protected by associated horizontal slide doors, a mechanical interlock device at each landing that prevents a landing door from opening without the presence of the car in registration with the landing, a door lock on the car for normally preventing the car door from opening when the car is out of registration with any landing, the interlock device being arranged to mechanically enable the door lock to release the car door to open when the car is in registration with a landing.

8 Claims, 3 Drawing Sheets

CAR DOOR LOCK

BACKGROUND OF THE INVENTION

The invention relates to doors for elevators, in particular, locking mechanism to prevent unintended opening of such doors.

PRIOR ART

As used hereinafter, the term "freight elevator" or "elevator" for short, will be understood to also apply to passenger elevators, goods lifts and other systems of similar function whether or not commonly described by these terms. Operators, passengers, and goods on an elevator are protected by a door carried on the elevator car while they and others are also protected by a separate door closing the elevator shaft at each landing. It is desirable, for such protection, that both the car door and landing doors be locked closed when the car is displaced away from a landing either vertically or horizontally. Various systems and devices have been proposed and/or produced to assure the locking of elevator car doors and landing doors. There has remained a need for a simple, reliable door locking system for freight elevator cars and landing doors including those with power door operators.

SUMMARY OF THE INVENTION

The invention provides, for freight elevators and the like, an integrated locking system for both elevator car and landing doors. More specifically, the locking system comprises a set of elements, essentially all mechanical, that serve to maintain a door of the car and the doors of the landings the car serves closed when the car is out of registration either vertically or horizontally with a landing. The system is arranged with lock control elements on the car and at the landings. These car and landing elements are ordinarily in mutual alignment and are conditioned for lock release only when the car is in the correct position at a landing. A driven one of the elements on the car is displaced automatically when a car door operator is energized. The driven element, with the condition that the car is properly vertically and horizontally positioned at a landing, is capable of unlocking both the associated landing door and the car door. The driven element, activated by the door operator, engages an element fixed on the landing door lock release and, in turn, this landing door release element displaces a car door lock release element. The various elements are arranged so that the landing door lock release element cannot be engaged by the driven element nor is it interposed between the driven element and the car door release element when the car is not registered with the landing. This condition of disconnection or disabling of the driven element ensures that the landing and car doors remain locked.

The disclosed door locking device is applied to horizontally sliding doors. The locking and unlocking elements for the most part rely on pivotal motion and thereby avoid erratic movement frequently encountered with translation or straight-line action induced by friction sticking at flat contacting or guiding surfaces of the locking elements.

DESCRIPTION OF THE PREFERRED EMBODIMENT

Figure 1:
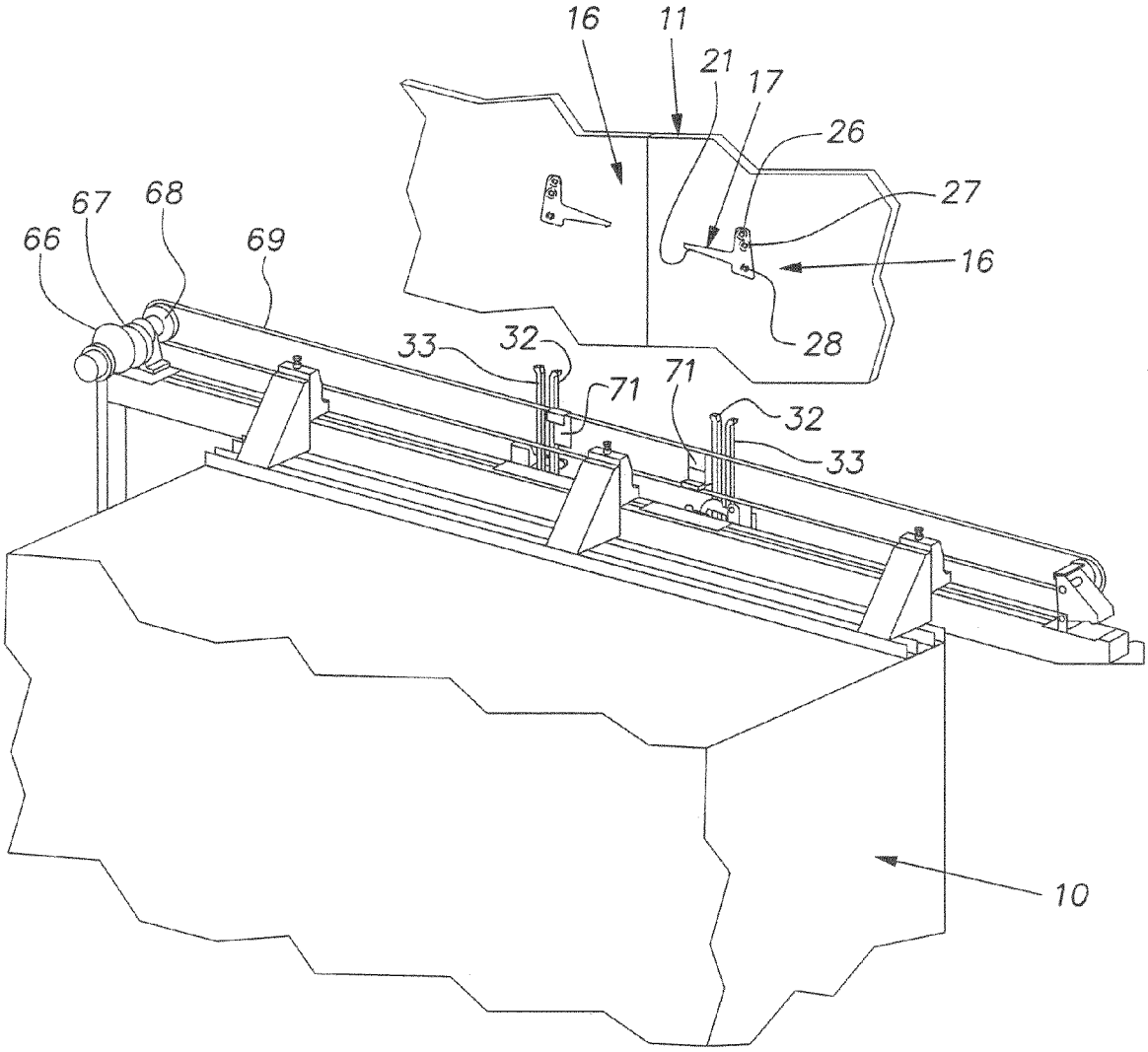
FIG. 1 is a fragmentary schematic perspective view of a freight elevator car on which a door locking device of the invention is employed.
Figure 2A:
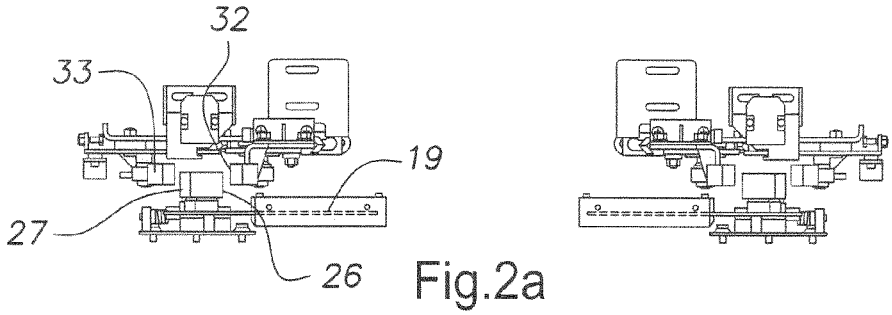
FIG. 2*a* is a plan view of the locking device of FIG. 2.
Figure 2:
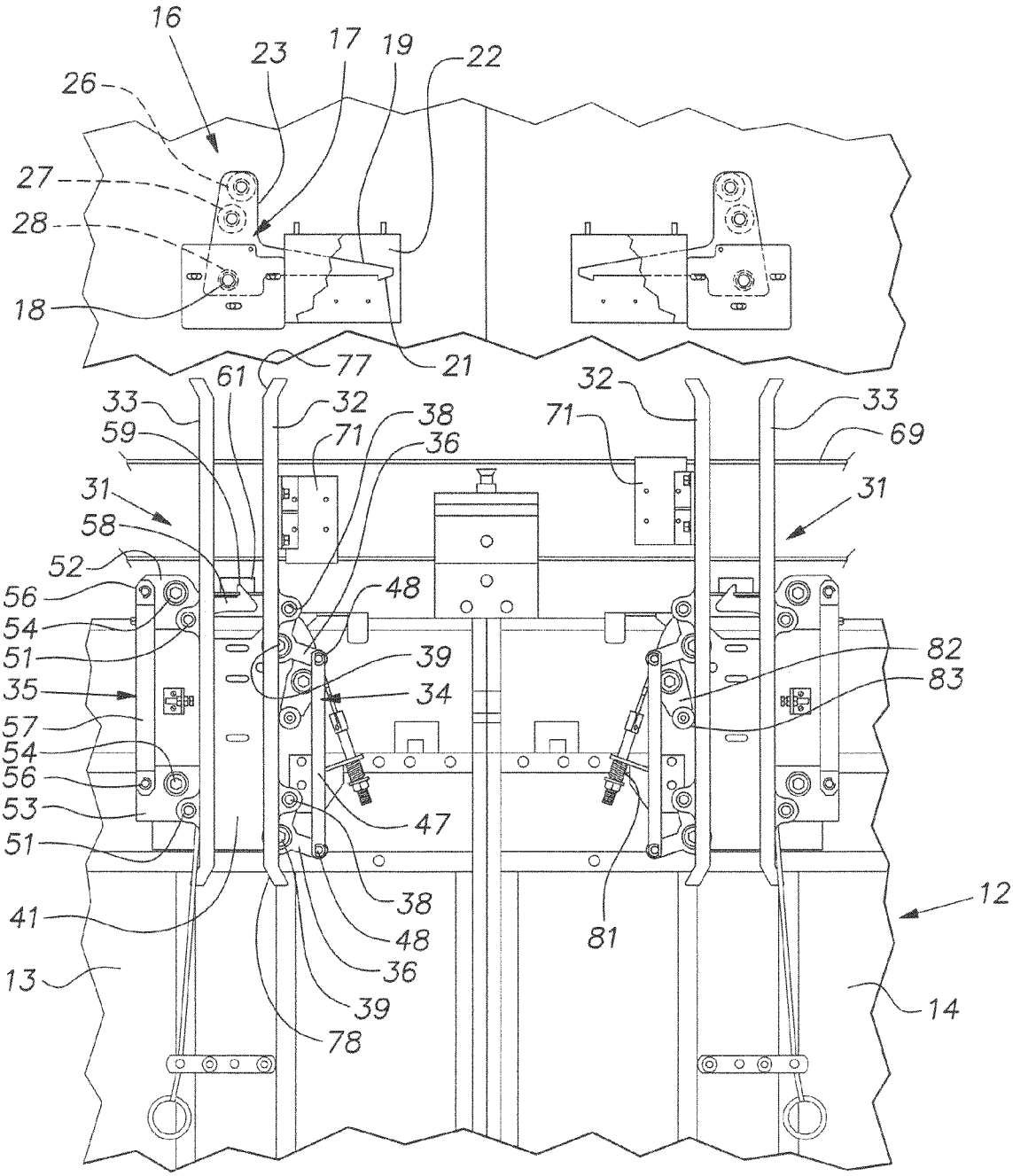
FIG. 2 is an elevational view of the locking device taken from an outside front view of the top area of the freight elevator car with the car shown at a location below that of registration with a landing.

Referring now to the figures and, in particular, FIG. 1, an elevator car 10 suitable for carrying freight or goods is shown. The car 10 moves vertically in a shaft to serve multiple landings spaced vertically from one another as is customary. Passage between the shaft and the car 10 is controlled by a landing or entrance door schematically illustrated at 11 and representative of a door at each landing. The landing door 11 is of the center-opening, horizontal sliding type such that one-half of the door slides to the right and one-half to the left. While not illustrated in detail, the right and left portions of the door 11 can each be comprised of multiple panels that are synchronized in their horizontal sliding movement as is known in the industry. The elevator car 10 is supplied with a similar center-opening, horizontal sliding door 12 having a right side 13 and left side 14 when viewed from the interior of the car 10.

The invention provides a mechanical locking system for the car door 12 and each landing door 11 that in regular duty prevents these doors from being opened when the car 10 is not aligned or registered with a landing. The locking system disclosed herein will be seen to be "mechanical" such that it is conditioned to release the car door and a particular landing door by the physical presence of the car 10 at a proper position in registration with the landing.

At each landing 11, the door locking system includes a door interlock assembly 16 arranged to releasably lock its respective landing door closed. The interlock assembly 16 is duplicated in right and left-hand versions, i.e. mirrored respectively, for the right and left-hand portions of the entrance door 11. Each interlock assembly 16 includes a bell crank type structure 17 that pivots about a center 18 fixed on a respective left or right portion of the door 11. The crank 17 includes a generally horizontal arm 19 with a depending hook 21 adapted to latch onto a bracket 22 fixed to the respective landing. A generally vertical arm 23 of the bell crank 17 extends upwardly from the horizontal arm 19 and pivot center 18. The arm 23 carries two cam rollers 26, 27 one spaced above the other and both spaced above a third cam roller 28 located with its axis concentric with the pivot center 18.

The right and left sides 13, 14 of the car door 12, like the entrance door 11, can have multiple panels that are synchronized in their horizontal sliding movement for opening and closing. The door locking system includes a locking device 31 associated with each car door side 13, 14. The device 31 associated with the right and left door panels are symmetrical, i.e. mirrored. The locking device 31 has a pair of spaced opposed vertical bars, one bar 32 is "driven" and one bar 33 is a "lock bar". Each bar 32, 33 is part of a respective four bar linkage generally designated by the numerals 34, 35 that ensures it remains vertical while being capable of moving a limited distance towards, with, or away from the other bar in a vertical plane common to the other bar.

Figure 5A:
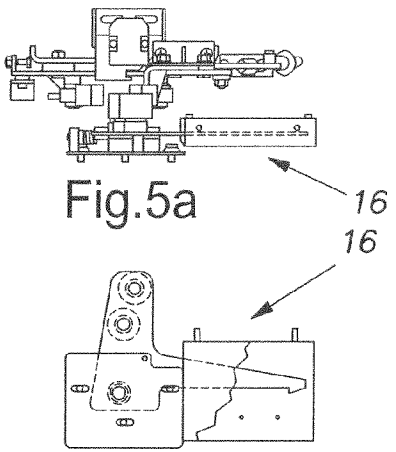
FIG. 5*a* is a plan view of the device as positioned in FIG. 5.
Figure 5:
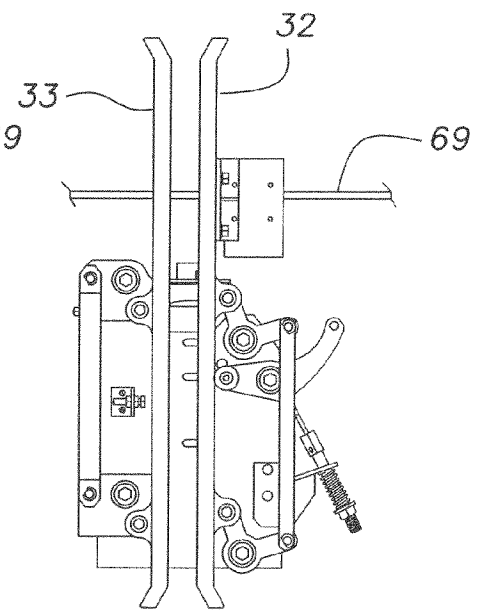
FIG. 5 is a view similar to FIG. 3, but showing positions of the locking device where a fault has occurred and the device continues to lock the associated door panel.
Figure 4A:
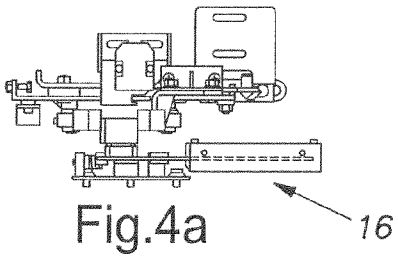
FIG. 4*a* is a plan view of the device as positioned in FIG. 4.
Figure 4:
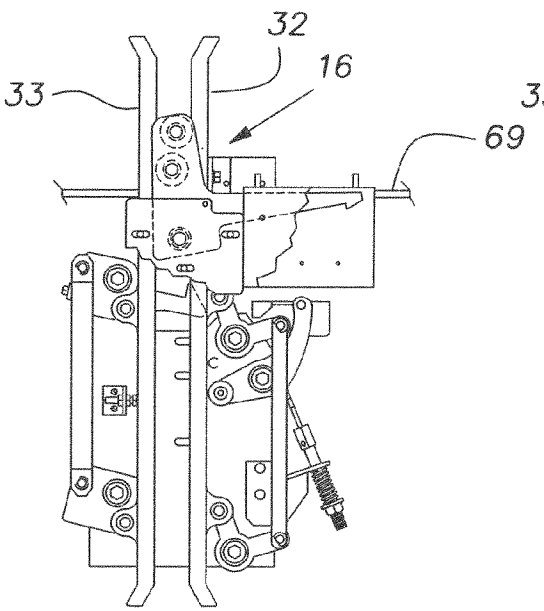
FIG. 4 is a view similar to FIG. 3 but with the elevator car in registration with the landing and, specifically, showing a landing door locking part of the device in a release position.
Figure 3A:
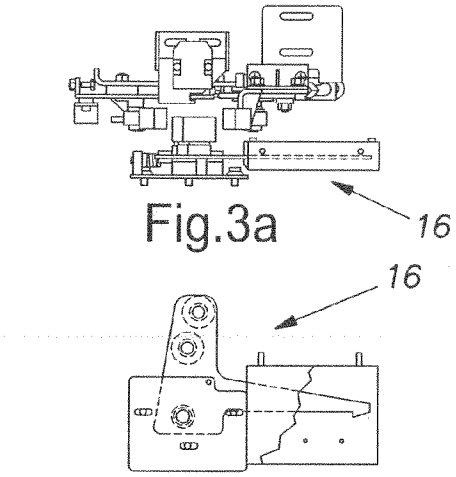
FIG. 3*a* is a plan view of the device of FIG. 3.
Figure 3:
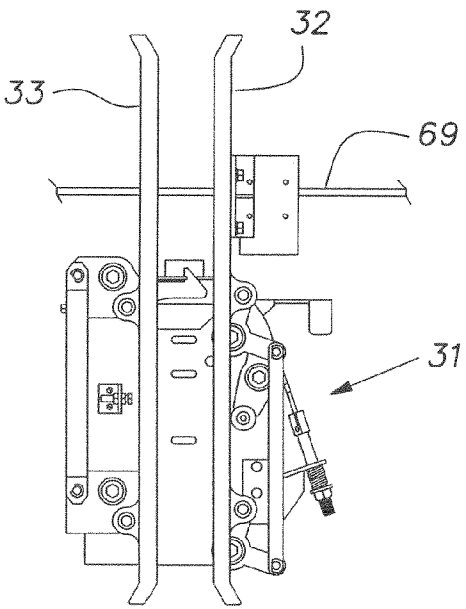
FIG. 3 is an elevational view of a right-hand part of the locking device for a right-hand horizontally sliding door panel, the right-hand orientation being taken from the reference of a person standing in the elevator car, the left hand part of the locking device being essentially a mirror image.

FIGS. 3-5 illustrate a right-hand locking device 31 with the orientation referenced from within the elevator car 10. The driven bar 32 is pivotally supported on a pair of bell crank levers 36 forming parts of the four bar linkage 34. The driven bar 32 is connected to arms of the bell crank levers 36 with pin joints 38. The bell crank levers 36 are pivotally supported on respective cantilevered pins 39 projecting from a bracket or plate 41. The plate 41 is fixed to the respective door panel 13. Other arms of the bell crank levers 36 pivotally support a connecting link 47, the remaining element of the four bar linkage 34, on pins 48. The bell crank levers 36 and link 47 support the driven bar 32 in a vertical orientation and for limited, generally translatory horizontal motion.

The lock bar 33 is supported on the bracket or plate 41 in a manner similar to that of the driven bar 32. The lock bar 33 is assembled on pins 51 carried on levers 52, 53. The levers 52, 53 pivot on pins 54, fixed on the bracket 41. Pins 56 on the levers 52, 53 support a bar 57 that serves as a counterweight and connecting link. The lock bar 33, levers 52, 53 and counterweight bar 57 work as the four bar linkage 35 and support the lock bar for limited generally horizontal translatory motion. The counterweight bar 57 resiliently biases the lock bar 33 horizontally towards the driven bar 32.

Integral with the upper lever 52 is a generally horizontal arm 58 with an upstanding lock or hook 59 adjacent its distal end. The counterweight 57 serves to resiliently bias this hook 59 upwardly to the position illustrated in FIG. 3 where it locks onto a bracket 61 fixed to the elevator car 10. When the hook 59 is engaged with the bracket 61, the associated elevator car door panel forming the right side 13 of the car door is prevented from opening. As shown in the various figures, a similar arrangement is provided for the panel on the left side 14 of the elevator car door 12.

The car door panels are power operated by an electric motor 66 (FIG. 1). Suitable electrical controls, under proper conditions, energize the motor 66 in one rotary direction to open the door panels and in the opposite rotary direction to close the door panels. The motor 66 driving through a gear box 67 and toothed pulley 68 is connected to the door panels with a high torque or high force toothed belt 69. An upper strand or reach of the belt 69 is fixed to the right door panel 13 and the lower reach of the belt is fixed to the left door panel 14. More specifically, the belt 69 is anchored by brackets 71 to the driven bar 32 of the locking device 31 at both the right and left sides 13, 14 of the car door 12.

The following is an explanation of the automatic operation of the lock devices 16, 31. FIGS. 3*a*, 4*a* and 5*a* show that the right door panel cam rollers 26, 27 of the interlock assembly 16 are installed in a vertical plane that is common to these rollers and, normally, to the driven and lock bars 32, 33, the latter elements forming lock control bars of the car door locking device 31. The same is true for the left hand door panel, rollers 26, 27 and driven and lock bars 32, 33. The car door locking devices 31 travel vertically with the car and when a car door panel is horizontally opened or closed, the locking device or assembly as well as the adjacent companion landing door panel and interlock assembly 16 travels horizontally with the car door. From FIGS. 3-5, it will be seen that when the motor 66 opens a car door panel through forces transmitted by the belt 69 to the associated driven bar 32 of the locking device 31, the driven bar will simultaneously open the companion landing door panel by engagement with the cam roller 28, recognizing that the latter cam roller is fixed relative to its associated landing door panel.

The landing and car door locks 16 and 31 are not readily accessible to a person in the car 10 and are normally intended to be released automatically, if the car is properly registered with a landing, by operation of the car door operator or motor 66. Assuming the car 10 is properly located at a landing as depicted in FIGS. 4 and 4*a*, the door operating motor 66 is energized to open the car door and the landing door. Initial movement of the belt 69 to open the door panels 13, 14 moves the driven bars 32 in a generally horizontal direction by swinging them on their respective levers 36. With the car 10 registered with a landing 11, the cam rollers 26-28 are interposed between the associated driven and lock bars 32, 33. Consequently, motion of the driven bar 32 is transmitted to the lock bar 33 through the rollers 26-28. More specifically, the bell crank 17 of the interlock assembly or landing door lock 16 is rotated by contact of the driven bar 32 with the upper roller 26. Pivotal movement of the bell crank arm 17 causes the middle roller to move the lock bar 33 of the car door locking device 31 generally horizontally by swinging on the levers 52, 53, overcoming the bias force of the counterweight 57. Swinging the lever 52 causes the hook 59 to be lowered, thereby releasing its lock on the fixed bracket 61. Further motion of the belt 69 and driven bar 32 draws the door towards its open position by force applied through the bracket 71. Simultaneously, each landing door panel is opened by force applied by the respective car door driven bar 32 to the lower roller 28, which is fixed relative to the respective landing door panel.

The landing door lock hook 21 is raised to release its grip on the fixed bracket 22 by engagement of the upper roller 26 with the driven bar 32. This engagement can be initiated when the car moves into the zone of the respective landing and an upper or lower camming edge 77 or 78 of the driven bar 32 contacts the roller 26. Unlatching of the landing door panel may be completed as the driven bar 32 is moved in the door opening direction and the roller 26 further pivots the bell crank 17.

With reference to FIG. 4*a*, it will be understood that with the lower roller 28 engaged by the driven bar 32 or the lock bar 33, the landing door panels are automatically opened and closed by the motor 66 in unison with the car door panels 13, 14. When the landing and car door panels are moved by the motor 66 to the closed position, the weight of the interlock arm 19 causes the landing door hook to relatch and the counterweight 57 causes the car door hook 21 to latch or relock.

From the foregoing, it will be understood that, assuming a car 10 is properly aligned at a landing, the initial movement of the car door operating motor 66 serves to unlock the car door panels 13, 14 and the corresponding landing door panels 11. The initial motion of the motor 66 in a sense is "lost motion" with respect to the car and landing doors since only the driven bar and lock bar 32, 33 move in this stage. After the lock bar 33 is moved a sufficient distance to lower the lock hook 59, the motor 66 moves the door panels toward their open positions.

FIGS. 3, 3*a*, 5 and 5*a* illustrate conditions where the car 10 is out of registration, e.g. below, a landing 11 and, consequently, the interlock cam rollers 26 28 of the landing door lock or interlock assembly 16, are out of the space between the driven and lock bars 32, 33. In this condition, the driven bar 32 cannot pivot the landing door lock bell crank 17 to unlock its hook 21 nor can it influence the car door lock bar 33 to release its lock hook 59. FIG. 5 illustrates a condition where the driven bar 32 has been moved to its unlocking position but is rendered ineffective to displace the lock bar 33 because of the absence of the cam rollers 26, 27 in the space between these bars. Note with reference to FIGS. 3*a*, 4*a* and 5*a*, the same ineffectiveness of the driven bar 32 to unlock both the landing and car door locks obtains where the elevator car is horizontally displaced from a landing so that the cam rollers 26-28 do not extend into the space between the driven and lock bars 32, 33 even where the car is vertically registered with a landing.

In the event of electrical power failure, malfunction of the door operating motor 66 or a broken belt, the car door locking device 31 and landing door lock 16, will automatically open, if the car 10 is properly registered with the landing 11, by force of a spring 81. The spring 81 operates to pivot a lever 82 carrying a cam roller 83 bearing against the driven bar 32 to move the driven bar bell crank 17 with associated cam rollers 26-28 and the lock bar 33 to their respective door unlocking positions.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A door locking system for a freight or passenger elevator or goods lift installation having vertically spaced landings served by a vertically movable car, the landings and car each being protected by associated horizontal slide doors, a mechanical interlock device at each landing that prevents a landing door from opening without the presence of the car in registration with the landing, a door lock on the car for normally preventing the car door from opening when the car is out of registration with any landing, the interlock device being positioned to mechanically enable the door lock to release the car door to open when the car is in registration with a landing, said interlock device being responsive to vertical movement of said car, said interlock device being pivoted by elements on said car to release its associated landing door.

2. A door locking system as set forth in claim 1, including a power actuator on the car for opening the car door, the car door lock being responsive to a door opening force developed by said power actuator to release said car door.

3. A door locking system as set forth in claim 1, wherein said car door lock includes elements supported by pivotal members for mechanical actuation to effectuate a release of said car door lock.

4. A door locking system as set forth in claim 3, wherein said supported elements include generally vertically oriented surfaces that inter-engage with said interlock device.

5. A door locking system for a freight or passenger elevator or goods lift installation having a car with a horizontal sliding door and vertically spaced landings each with a horizontal slide door, a landing door interlock device mechanically operable to unlock an associated landing door, a car door lock that maintains the car door closed when the car is not at a landing and that allows the car door to open when the car is properly located at a landing, the car door lock having a pivotally supported driven element and a pivotally supported lock element, the car door lock being mechanically enabled by the interlock device to open the car door by the physical presence of a rigid body in a line of door opening force between the driven and lock elements and being mechanically disabled with the driven and lock elements being rendered pivotally independent by the absence of said rigid body in said line of force, the interlock device and car door lock being responsive to vertical movement of the car to locate said rigid body in or out of said line of force.

6. A door locking system for a freight or passenger elevator or goods lift installation having a car with a horizontal sliding door and vertically spaced landings each with a horizontal slide door, a landing door interlock device mechanically operable to unlock an associated landing door, a car door lock that maintains the car door closed when the car is not at a landing and that allows the car door to open when the car is properly located at a landing, the car door lock having a pivotally supported driven element and a pivotally supported lock element, the car door lock being mechanically enabled by the interlock device to open the car door by the physical presence of a rigid body in a line of door opening force between the driven and lock elements and being mechanically disabled by the absence of said rigid body in said line of force, the interlock device and car door lock being responsive to vertical movement of the car to locate said rigid body in or out of said line of force, the car door lock including a pair of spaced parallel vertical surfaces formed by said driven and lock elements and said interlock device having said rigid body mounted to pass between said surfaces when the car moves in and out of registration with the landing.

7. A door locking system as set forth in claim 6, including a car door operating drive motor connected to said driven element, said driven element transmitting a force developed by said drive motor as said motor is initially operated to open the car door to said lock element to thereby release said lock.

8. A door locking system as set forth in claim 7, wherein said interlock device transmits the car door lock operating force between said driven and lock elements as the rigid body pivots about a center.

* * * * *